US006309811B2

(12) United States Patent
Allway et al.

(10) Patent No.: US 6,309,811 B2
(45) Date of Patent: Oct. 30, 2001

(54) COLOR PHOTOGRAPHIC ELEMENT CONTAINING NITROGEN HETEROCYCLE DERIVATIVE AND INHIBITOR RELEASING COUPLER

(75) Inventors: Philip A. Allway, Herts (GB); Louis E. Friedrich, Rochester; Stephen P. Singer, Spencerport, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/358,101

(22) Filed: Jul. 21, 1999

(51) Int. Cl.[7] ..... G03C 1/08; G03C 7/26; G03C 7/32

(52) U.S. Cl. ..... 430/544; 430/505; 430/955; 430/957; 430/607; 430/613; 430/614; 430/599; 430/600

(58) Field of Search ..... 430/505, 544, 430/955, 957, 607, 613, 614, 615, 599, 600, 543

(56) References Cited

U.S. PATENT DOCUMENTS

| | | | | |
|---|---|---|---|---|
| 3,671,255 | | 6/1972 | Haga et al. . | |
| 4,477,563 | | 10/1984 | Ichijima et al. . | |
| 4,720,451 | | 1/1988 | Shuto et al. . | |
| 4,920,043 | | 4/1990 | Ohashi et al. . | |
| 5,158,864 | * | 10/1992 | Matejec et al. | 430/544 |
| 5,275,931 | | 1/1994 | Saitou et al. . | |
| 5,389,509 | * | 2/1995 | Maskasky | 430/615 |
| 5,508,154 | | 4/1996 | Mizukawa et al. . | |
| 5,523,202 | * | 6/1996 | Ohtani et al. | 430/615 |
| 5,610,003 | * | 3/1997 | Lussier | 430/543 |
| 6,054,257 | * | 4/2000 | Boff et al. | 430/544 |
| 6,140,029 | * | 10/2000 | Clark et al. | 430/614 |
| 6,190,848 | * | 2/2001 | Boff et al. | 430/544 |
| 6,190,849 | * | 10/2000 | Burns et al. | 430/544 |

FOREIGN PATENT DOCUMENTS

| | | |
|---|---|---|
| 19507913 | 3/1995 | (DE) . |
| 0369486 | 3/1997 | (EP) . |
| 59-159162 | 9/1984 | (JP) . |
| 60-29390 | 7/1985 | (JP) . |
| 60-217358 | 10/1985 | (JP) . |
| 63-193147 | 8/1988 | (JP) . |
| 1-137255 | 5/1989 | (JP) . |
| 4-204937 | 7/1992 | (JP) . |
| 57-125939 | 8/1992 | (JP) . |

* cited by examiner

*Primary Examiner*—Geraldine Letscher
(74) *Attorney, Agent, or Firm*—Arthur E. Kluegel

(57) ABSTRACT

Disclosed is a color photographic element comprising:

a) a first light sensitive silver halide emulsion layer containing a compound with an aromatic bicyclic nitrogen nucleus of which at least one ring is six-membered and with two nitrogen ring atoms in each ring and with at least one N—H bond provided that the ClogP for the compound is at least 2.0 and less than 7.2; and (b) a second light sensitive silver halide emulsion layer, having a spectral sensitivity different from that of the first light sensitive silver halide emulsion layer, containing a compound of Formula III:

$$\text{COUP-(TIME)}_j\text{-INH} \qquad \text{III}$$

wherein:

COUP is a coupler parent group capable of forming a dye upon reaction with an oxidized developer;

TIME is a timing group and j is 0,1 or 2; and

INH is a mild silver development inhibitor fragment.

The invention provides improved color reproduction.

37 Claims, No Drawings

COLOR PHOTOGRAPHIC ELEMENT CONTAINING NITROGEN HETEROCYCLE DERIVATIVE AND INHIBITOR RELEASING COUPLER

FIELD OF THE INVENTION

This invention relates to a color photographic element containing a compound that contains an aromatic bicyclic nitrogen nucleus of which at least one ring is six-membered and with two nitrogen ring atoms in each ring and with at least one N—H bond dispersed in one light sensitive layer and in a second light sensitive layer having a different spectral sensitivity than the first layer, a mild inhibitor releasing coupler.

BACKGROUND OF THE INVENTION

It is an object of silver halide-based color photographic materials to reproduce colors in both an accurate (in terms of hue) and vivid (in terms of saturation) manner. In practice, the reproduction of color by such materials is limited in two ways. First, the sensitivity of the silver halide emulsions to a desired single light color is not perfect and they will absorb some amount of light of undesired color. This leads to formation of dye in the wrong color record resulting in less pure hues. For example, the red sensitivity of the emulsions generally occurs at longer wavelengths than the human eye. If the red sensitivity of the film is moved closer to the eye maximum sensitivity, its sensitivity to green light also increases. Thus in such situations, the red sensitive layer is partially exposed during green light exposures leading to the formation of some cyan dye along with magenta dye. This alters the hue of the image and decreases its saturation. Second, the image dyes formed are not perfect in hue and have unwanted side absorbencies. Thus, some density in the unwanted color regions is formed in addition to the desired density, again degrading color saturation. Finally in some circumstances, it is desirable to increase color saturation to a greater degree than the actual image in order to make the image visually more pleasing.

It is well known that color reproduction of such materials can be partially controlled by the use of imagewise development inhibitor releasing (DIR) couplers. During development, DIR couplers react with oxidized developer to release an inhibitor fragment or a precursor of an inhibitor fragment which can diffuse out of that layer and into a different color record where inhibition occurs. This has the overall effect of reducing the amount of dye formed in one color record as a function of exposure of another and can effectively be used to manipulate hue and increase color saturation. This process is called interimage. For example, a film with a DIR coupler in the green layer and given a mostly green exposure will cause a decrease in development in the red record due to the action of the inhibitor released in the green. This causes less cyan dye to be formed than when the inhibitor was not present. The final green image will have less red density and its overall saturation will be increased. It should be noted that all possible colors are not weighted equally in terms of creating a pleasing overall image and that the reproduction of some key colors (for example, flesh tones, green grass, blue sky, etc.) are more important than others.

The creation of interimage effects with DIR couplers is deficient in a number of ways. First, the inhibitor fragment (or precursor) released from the DIR coupler is free to diffuse in all directions. Thus, the inhibitor can affect both of the other color records, even if it was desired to only affect one. For example, putting the DIR coupler in the green will decrease the amount of blue development as well as the red. The amount of interimage effects on the blue and red records from the green are linked and cannot be manipulated separately. This non-specificity of interimage effects limits the ability to control and manipulate color reproduction of the key colors.

Second, the fragment released from the DIR will cause inhibition in the layer in which it is released. This can lead to over-inhibition of the layer in which the DIR coupler is located resulting in low contrast and a loss in sensitivity to light, particularly with strong inhibitor fragments. It is possible to avoid this in part by using milder inhibitors or by using timing groups to delay the introduction of the free inhibitor fragment. In such situations, the diffusion path-length of the inhibitor fragment is increased and seasoning of the fragments into the developer becomes a problem. In order to avoid these seasoning effects, mild inhibitor fragments often have a hydrolyzable substituent which, upon hydrolysis in the developer solution, renders them inactive after a period of time. Examples are shown in U.S. Pat. Nos. 4,782,012, 4,477,563, 4,937,179, 5,004,677, DE-A 3909486, DE-A-3209486, EP-A-167,168, EP-A-488,310, EP-A-440,466 and EP-A-219,173.

Substituted purines and 1H-pyrazolo[3,4-d]pyrimidines are known to be useful in photographic systems as antifoggants; for example, as in Japanese Patent Applications JP 07-281345A2; JP 03-013934A2; JP 03-138639A2; JP 04-107446A2; JP 04-067140A2 and JP 05-127290A2 and as described in E. J. Birr, *Stabilization of Photographic Silver Halide Emulsions,* Focal Press, Ltd, 1974, pp 82–83. As antifoggants, these materials are generally at least partially water soluble or soluble in water-miscible solvents such as methanol and are added directly to silver emulsions before coating of the film or added directly to the developer solutions. Purines are also described in Def. Publ. U.S. Pat. No. 877,011 to be useful as silver pi-complex stabilizers in photographic systems. Purines used as inhibitor fragments as part of a DIR are disclosed in U.S. Pat. No. 3,933,500. Purines as a blocking group for the release of photographically useful groups during processing are described in JP 04-186344A2 and EP-335319A2. Derivatives of 6-aminopurines as addenda in high contrast black and white media containing not DIR couplers have been described in JP10-104784A2; JP10-228077A2; JP09-106024A2 and JP04-336538A2. U.S. Pat. Nos. 5,411,929 and 5,328,799 describe the use of purines, including 6-dodecylaminopurine (ClogP=6.21), in coupler-free thermally processed image recording materials.

U.S. Pat. No. 5,508,154 describes the use of 5/5 bicyclic heterocycles in which one ring is a 1,2,3-triazole, and both rings together contain a minimum of 4 nitrogen atoms as antifoggants in systems that contain inhibitor releasing couplers. Of the examples shown, these heterocycles have an average ClogP of 1.53 with a maximum of 5.67 (example A-7). The patentee also notes that 6/5 membered bicyclic heterocycles with 4 nitrogen atoms do not produce the desired result.

DE 1 95 07913 A1 describes the use of ballasted benzimidazoles to improve granularity particularly with certain pyrazolone image couplers.

A problem to be solved is to provide a color photographic element having improved color reproduction.

SUMMARY OF THE INVENTION

The invention provides a color photographic element comprising:

(a) a first light sensitive silver halide emulsion layer containing a compound with an aromatic bicyclic nitrogen nucleus of which at least one ring is six-membered and with two nitrogen ring atoms in each ring and with at least one N—H bond provided that the ClogP for the compound is at least 2.0 and less than 7.2; and (b) a second light sensitive silver halide emulsion layer, having a spectral sensitivity different from that of the first light sensitive silver halide emulsion layer, containing a compound of Formula III:

$$\text{COUP-(TIME)}_j\text{-INH} \qquad \text{III}$$

wherein:

COUP is a coupler parent group capable of forming a dye upon reaction with an oxidized developer;

TIME is a timing group and j is 0, 1 or 2; and

INH is a mild silver development inhibitor fragment.

The invention provides improved color reproduction.

DETAILED DESCRIPTION OF THE INVENTION

The invention is generally as described in the Summary of the Invention. The present invention relates to a light sensitive color photographic element with at least one red sensitive silver halide emulsion layer with at least one non-diffusing cyan coupler, at least one green sensitive silver halide emulsion layer with at least one non-diffusing magenta coupler and at least one blue sensitive silver halide emulsion layer with at least one non-diffusing yellow coupler, characterized in that at least one of the light sensitive silver halide emulsion layers also contains an aromatic bicyclic nitrogen nucleus of which at least one ring is six-membered and with two nitrogen ring atoms in each ring and with at least one N—H bond provided that the ClogP for the compound is at least 2.0 and less than 7.2; and in a light sensitive layer of different spectral sensitivity, a certain kind of inhibitor releasing compound.

The interimage effects caused by inhibitors released from remote layers can be greatly enhanced by the addition of the nitrogen heterocycle (herein referred to an Interimage Enabling Heterocycle or IEH) in the layer where the inhibition is desired.

In its most general form, the heterocyclic compound of the invention contains a minimum of two aromatic heterocylic rings that share a common ring bond; that is, two atoms are common to both rings. Each ring must separately contain two nitrogen ring atoms. No nitrogen atom can be located at a bridgehead position nor simultaneously shared between the two rings of the nucleus. At least one of these rings that comprise the inventive compound must be six-membered. The compound of the invention must have at least one N—H bond in which the nitrogen is part of the ring system. It should be noted wherever it is possible to write alternative tautomeric structures of the heterocyclic nucleus, these are considered to be chemically equivalent and are part of the invention.

The inventive nitrogen heterocycles are not couplers and do not react with oxidized developer. They are colorless. They are also stable to the processing solutions and do not contain substitutents that undergo substantial amounts of chemical reaction in any of the processing solutions. For example, the inventive materials do not contain hydrazino or hydroquinone groups that may cross-oxidize during silver development. However, the inventive materials may contain, for example, ester substitutents which are not substantially hydrolyzed during the development process. The materials of the invention are located in the film element and are not added to the processing solutions.

The generally preferred forms of the nitrogen heterocycle are 6/5 bicyclic tetraazaindenes. The numbering system for these types of heterocycles is as follows.

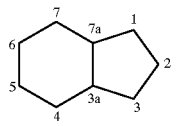

These compounds can be optionally substituted with additional groups to manipulate the silver emulsion absorbing or complexing ability and meet the ClogP requirements.

In particular, the generally preferred forms are purine (1,3,4,6-tetraazaindene) derivatives according to Formula I or 1H-pyrazolo[3,4-d]pyrimidine (1,2,5,7-tetraazaindene) derivatives according to Formula IIa or 1,2,4,6-tetraazaindenes according to Formula IIb

I

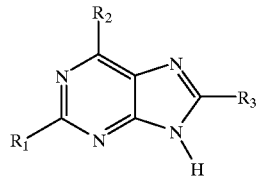

IIa

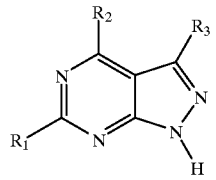

IIb

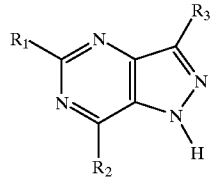

In the compounds of Formula I or Formula II, $R_1$, $R_2$ and $R_3$ are independently hydrogen or an alkyl, phenyl, ether, thioether, sulfoxide, sulfone, sulfamoyl

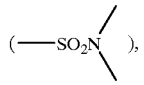

halide such as chloro or bromo, cyano, thiol, hydroxy, nitro, an —O— group, an —O—$SO_2$— group, a heterocyclic group, a carbonyl group such as keto, carboxylic acid (—$CO_2$H), carboxylate ester (—$CO_2$—) or carbamoyl

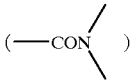

or an amino group such as a primary, secondary or tertiary substituted nitrogen, carbonamido (—NCO—) or sulfonylamido (—$NSO_2$—). These substituents may be connected to others to form additional ring systems and benzo-, naptho- or additional heterocyclic rings may be annulated to the heterocyclic bicycle nucleus to form compounds with more than two rings. A substitutent may also connect two or more independent nitrogen heterocycle nuclei together so long as the entire molecule still meets the ClogP limitations. In addition, the substitutent may further contain a group that can be incorporated into a polymeric backbone so long as the monomeric species meets the ClogP limitations. It should be noted that in Formulas I or II, various tautomers with the hydrogen attached to different nitrogens are possible. In addition, ionizable substitutents, such as hydroxy (—OH), thiol (—SH) or non-tertiary amino groups (—$NH_2$ or —NH—) that are directly attached to a ring atom adjacent to a ring nitrogen, can also form tautomers with the hydrogen attached to different atoms. Any of these tautomeric structures are chemically equivalent and are part of the invention.

Preferred examples of the purine compounds of Formula I, the 1,2,5,7-tetraazaindenes of Formula IIa and the 1,2,4,6-tetraazaindenes of Formula IIb of the invention are according to Formula IV, Formula Va and Formula Vb:

IV

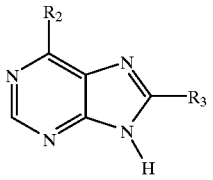

Va

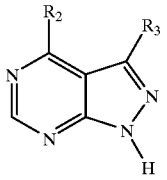

Vb

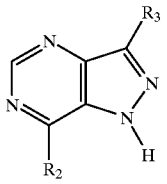

wherein $R_2$ and $R_3$ are as defined above. The most preferred examples are with $R_3$ is hydrogen. Especially preferred are compounds in which $R_2$ are alkyloxy, aryloxy, alkylthio, arylthio, sulfonyl, sulfoxide or amino groups.

An important feature of the IEIIs of the invention are their oil/water partition coefficient. The oil/water partition coefficient can be modeled using Medchem 3.54 to predict this value as ClogP. Medchem version 3.54 is a software program produced by the Medicinal Chemistry Project, Pomona College, California. In order to maximize the interimage effect, the water solubility cannot be so low that the material is unable to interact effectively with the silver surface. Thus, the overall ClogP of the IEH should be less than 7.2. It is suitable that the overall ClogP of the IEH is less than 7.0, typically less than 6.8 and desirably less than 6.2. However, the water solubility cannot be too great or the material becomes an effective inhibitor of silver development, thus causing a loss in sensitivity or may wander into other layers. Thus, it is necessary that the ClogP of the IEH be at least 2.0 or more preferably at least 3.0 or most preferably at least 4.0.

One way to enter a structure into the Medchem program in order to calculate a ClogP is through a SMILES string. The way to enter the SMILES string for the IEH is to enter all non-hydrogen atoms as capitals and let the Medchem program determine the appropriate aromaticity. An example is shown for compound IEH-A: CCCCCCCCCCOC1=C2N=CNC2=NC=N1. This entry gives the value 4.80. When the entry is in this form, the heterocyclic N—H will be drawn in the structure by the Medchem program. If the entry is not in this form, the heterocyclic N—H will not be shown by the Medchem program and the resulting ClogP value is incorrect. Compounds with a hydroxy or thiol substitutent on the ring can be drawn either as an enol/keto or thiol/thione tautomeric forms. The two forms would calculate to have different ClogPs. For purposes of this invention, the ClogPs of the enol form or thiol forms are used.

The laydown of the IEHs of the invention is also important to obtain the desired effect without excessive loss in sensitivity to light. Usually it is preferred to have a loss in sensitivity to light of no more than around 5 or 6% to avoid having to increase emulsion size and thus, increase granularity. In general, the ratio of IEH to silver should be at least 0.01 mmol of compound per mole of silver and more preferably, at least 0.1 mmol of compound per mole of silver but less than 5 mmol per mole of silver and more preferably, equal to or less than 2.5 mmol per mole of silver and most preferably, equal to or less than 1.0 mmol per mole of silver.

The following are examples of IEHs of Formulas I or II, along with the corresponding ClogP values, that are useful in this invention:

IEH-A:
(4.80)

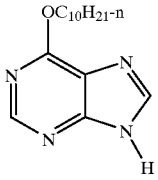

IEH-B:
(5.86)

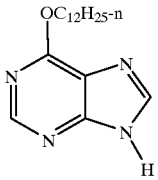

IEH-C:
(2.41)

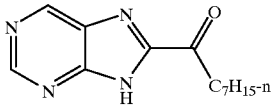

-continued
IEH-D:
(3.61)
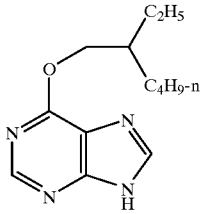
IEH-E:
(5.15)
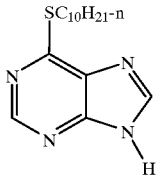
IEH-F:
(3.62)
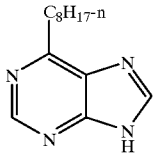
IEH-G:
(4.75)
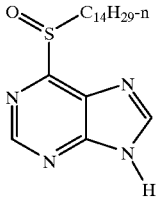
IEH-H:
(5.80)
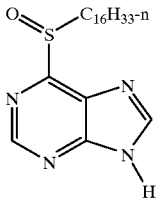
IEH-I:
(4.70)
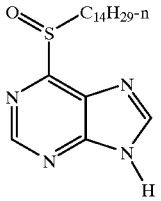
IEH-J:
(5.40)
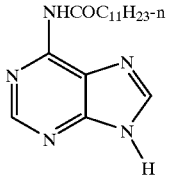
-continued
IEH-K:
(5.73)
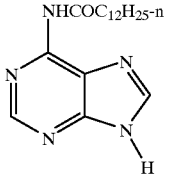
IEH-L:
(3.48)
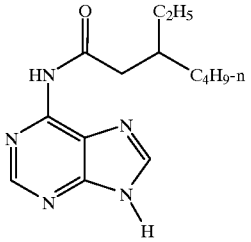
IEH-M:
(6.97)
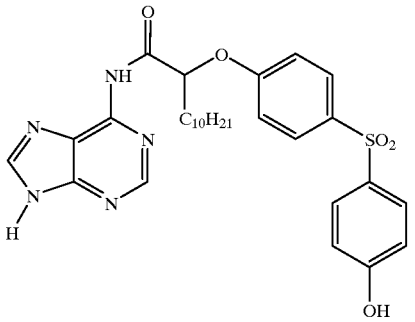
IEH-N:
(5.15)
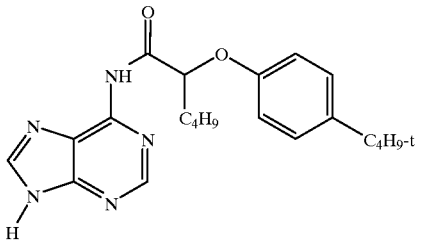
IEH-O:
(7.12)
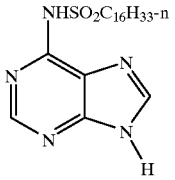
IEH-P:
(6.14)
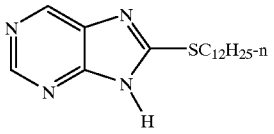

-continued

IEH-Q:
(6.92)

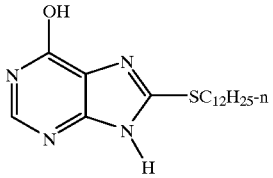

IEH-R:
(5.47)

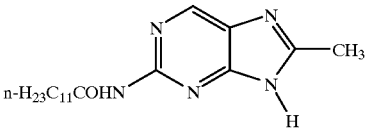

IEH-S:
(3.48)

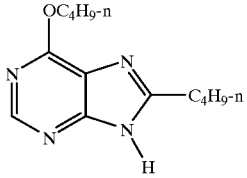

IEH-T:
(3.54)

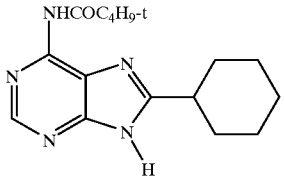

IEH-U:
(4.02)

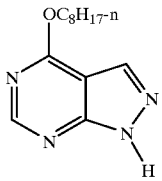

IEH-V:
(5.43)

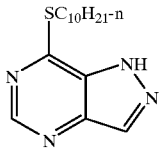

IEH-W:
(5.15)

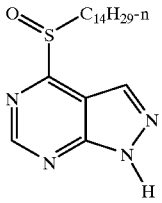

-continued

IEH-X:
(6.98)

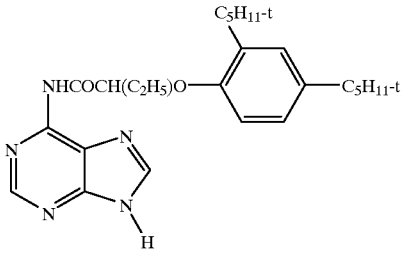

IEH-Y:
(4.57)

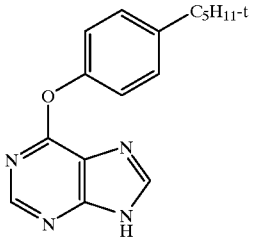

IEH-Z:
(3.54)

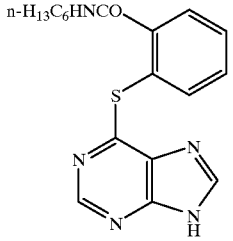

The mild DIR of the invention is represented by Formula III:

$$\text{COUP-(TIME)}_j\text{-INH} \qquad \text{III}$$

in which:

TIME represents a timing group attached to the coupling site of COUP;

j represents 0, 1 or 2; and

INH represents a mild silver development inhibitor fragment.

The DIR couplers of Formula III are well known in the art. The inhibitor fragment may be released directly or may be anchimerically released indirectly through the use of a timing group (a DIAR) as known in the art. As more fully described hereinafter, TIME is a group released from COUP with INH attached which instantly or with a time delay, then releases INH, an inhibitor fragment. The inhibitor fragment can be any of those that are normally relatively weak or mild in their ability to cause silver inhibition. If the fragments are mild inhibitors, then they would typically not cause much inhibition in either the layer in which they are released or in other layers. However, the IEHs of Formula I or II greatly increase the sensitivity to inhibition by these mild inhibitors in the layer in which the IEH is located. This allows for greater interimage effects in one specific layer relative to another, even if both receive the same amount of mild inhibitor fragment from the originating layer and without over-inhibition of the causing layer. This is accomplished by the locating the IEH in the receiving layer where increased inhibition is desired and the DIR coupler that releases the mild inhibitor in the interimage causing layer. The IEHs do not significantly alter the inhibition of their layer by strong inhibitors which might be released through other compounds; thus, strong inhibitors can be used in combination with the mild inhibitors of the invention simultaneously. The most desirable mild inhibitors are those that bear hydrolyzable groups; that is, groups such as esters that hydrolyze in the high pH of the developer. This helps prevent mild inhibitors from diffusing from the film and contaminating the developer solution. The rate of hydrolysis of the mild inhibitor in the developer is important; desirably, the half-life should be longer than 5 minutes in order to remain an effective inhibitor during development, but should be less than 24 hours in order to avoid seasoning effects.

The mild inhibitor fragments that are used in this invention are defined as those that cause less than a 45% gamma reduction, or more preferably less than a 40% gamma reduction, relative to a non-inhibitor containing check when coated as the following single layer film element on a cellulose triacetate film support (coverages are in g/m$^2$):

| | |
|---|---|
| Overcoat | Gelatin at 2.79 and 0.02 bis-vinylsulfonemethylether |
| Imaging Layer | Gelatin at 2.79<br>Magenta Image Coupler M-1 (dispersed at 80% by weight in tricresyl phosphate and 20% by weight N,N-dibutyl-2-butoxy-5-t-octylaniline) at 0.692<br>DIR being tested at 0.055 mmol/m$^2$<br>(dispersed in twice its weight in N,N-dibutyllauramide)<br>Green sensitized AgBrI at 1.08 |

Samples of each element were given a stepped exposure and processed in the KODAK FLEXICOLOR™ (C-41) process as described in *British Journal of Photography Annual,* 1988, pp 196–198. Contrast of the elements was determined using the maximum slope between any two density points.

TABLE I

Examples of Mild and Strong DI(A)Rs.

| Sample | DI(A)R | % Contrast Reduction |
|---|---|---|
| SL-1 | CDIR-1 | −55.4% |
| SL-2 | CDIR-2 | −67.1% |
| SL-3 | CDIR-3 | −75.7% |
| SL-4 | CDIR-4 | −77.1% |
| SL-5 | CDIR-5 | −70.5% |
| SL-6 | CDIR-6 | −75.4% |
| SL-7 | CDIR-7 | −63.9% |
| SL-8 | CDIR-8 | −49.2% |
| SL-9 | CDIR-9 | −50.1% |
| SL-10 | CDIR-10 | −53.8% |
| SL-11 | CDIR-11 | −58.6% |
| SL-12 | IDIR-1 | −34.5% |
| SL-13 | IDIR-2 | −25.3% |
| SL-14 | IDIR-3 | −24.5% |
| SL-15 | IDIR-4 | −22.6% |

TABLE I-continued

Examples of Mild and Strong DI(A)Rs.

| Sample | DI(A)R | % Contrast Reduction |
|---|---|---|
| SL-16 | IDIR-5 | −42.0% |
| SL-17 | IDIR-6 | −24.9% |
| SL-18 | IDIR-7 | −20.0% |
| SL-19 | IDIR-8 | −2.4% |

The following are the comparative strong DI(A)R couplers used in TABLE I.

CDIR-1:

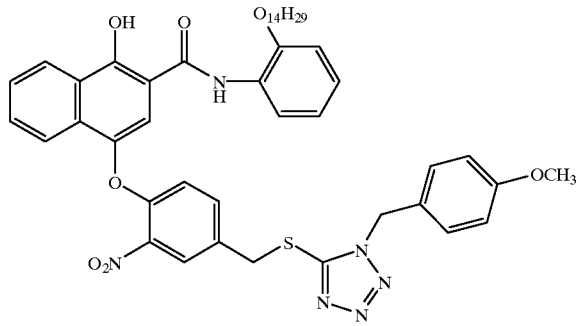

CDIR-2:

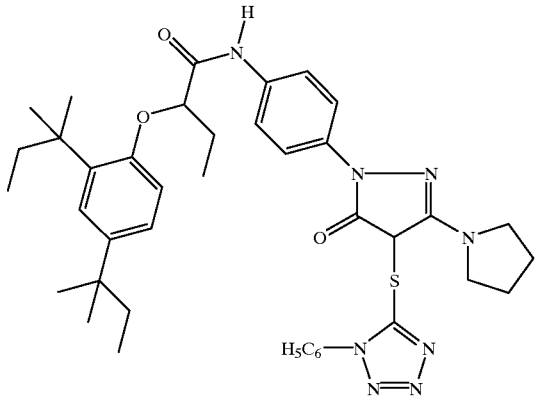

CDIR-3:

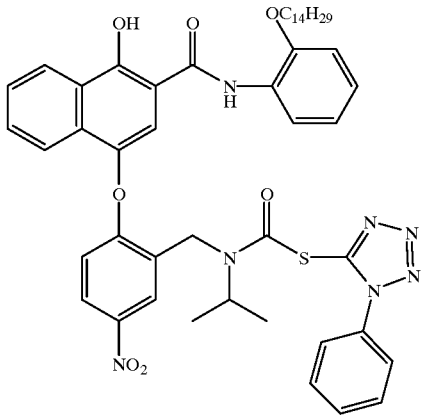

-continued

CDIR-4:

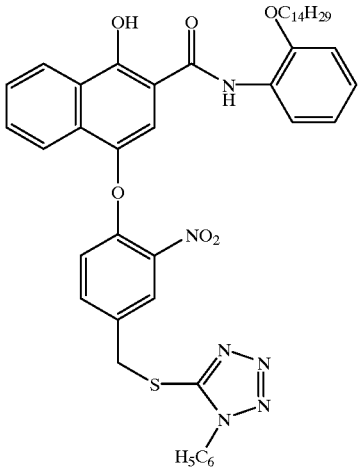

CDIR-5:

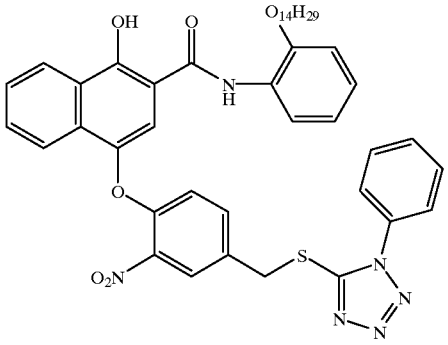

CDIR-6:

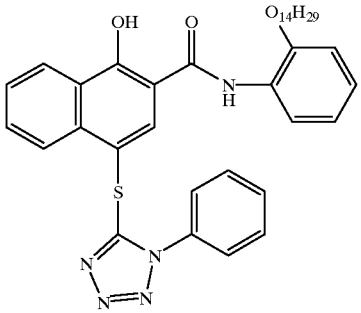

CDIR-7:

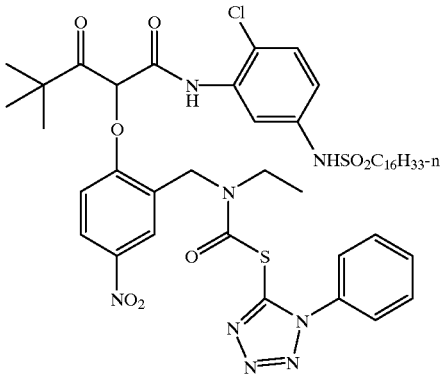

-continued

CDIR-8:

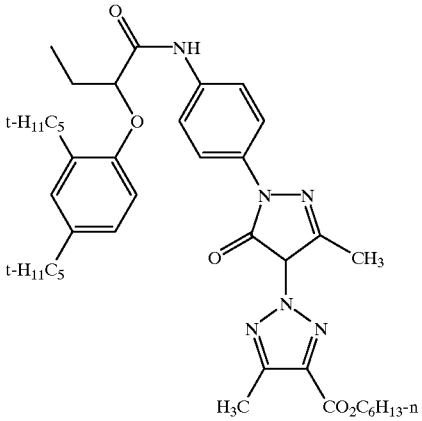

CDIR-9:

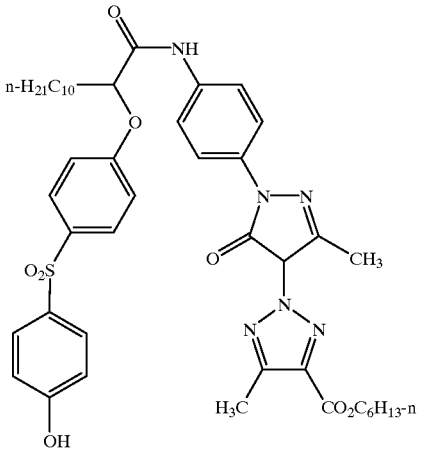

CDIR-10:

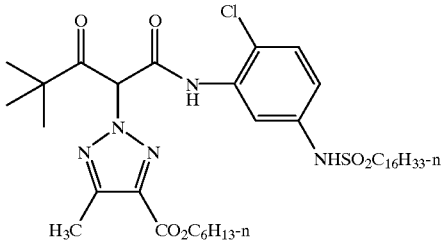

CDIR-11:

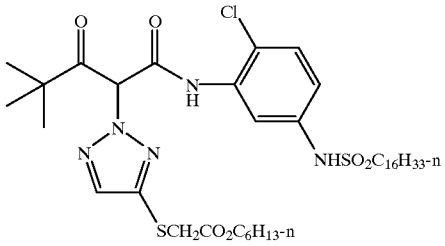

Specific examples of strong inhibitor fragments that are not part of this invention are phenylmercaptotetrazole, tetrabromobenzotriazole, p-methoxybenylmercaptotetrazole, 4-methyl-5-carboxyhexyl-1,2,3 -triazole and 6-hexylthioacetyl-1,2,3-triazole.

The following are examples of mild DIRs shown in Table I that are useful in this invention.

IDIR-1:
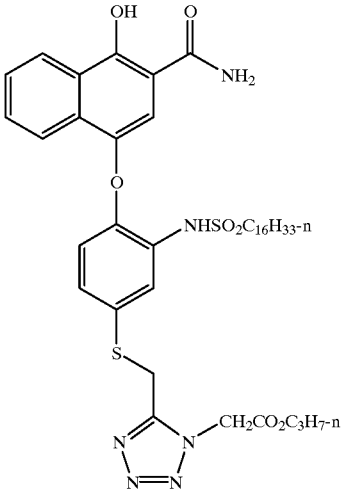
IDIR-2:
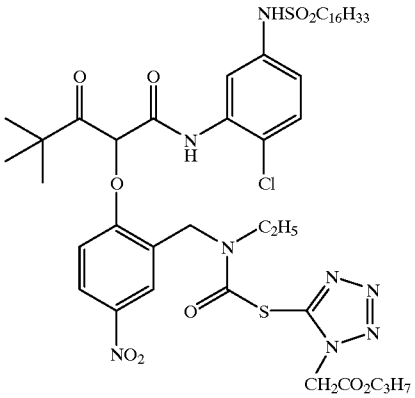
IDIR-3:
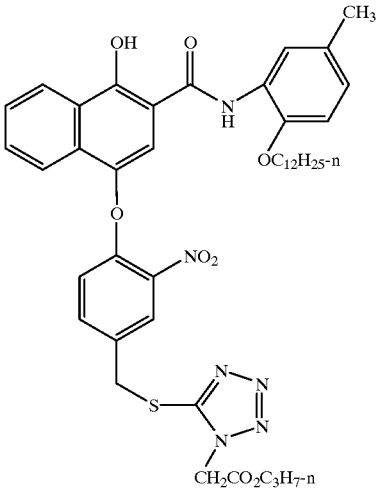
-continued
IDIR-4:
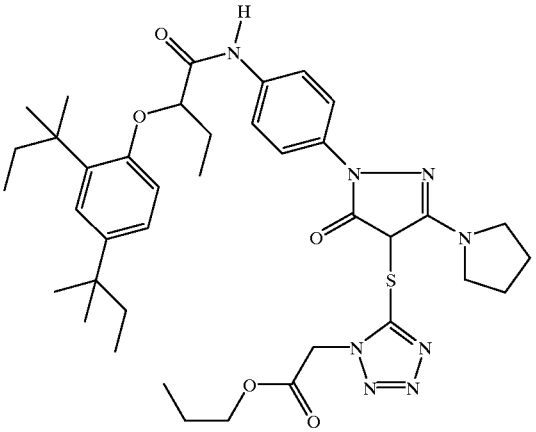
IDIR-5:
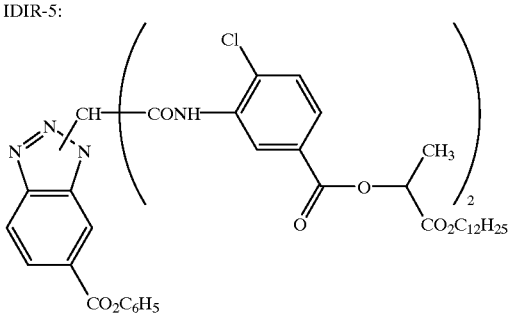
IDIR-6:
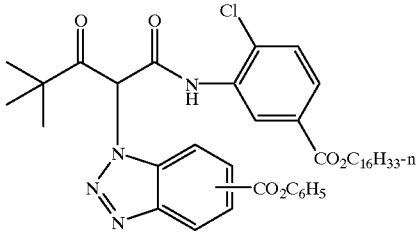
IDIR-7:
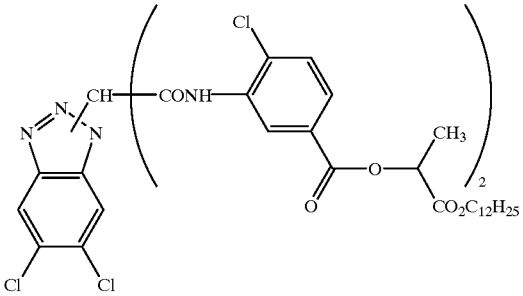
IDIR-8:
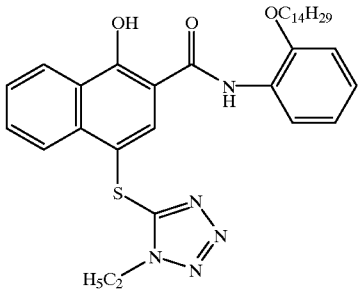

The following are additional examples of mild inhibitor fragments (INH in Formula III) useful in the invention:

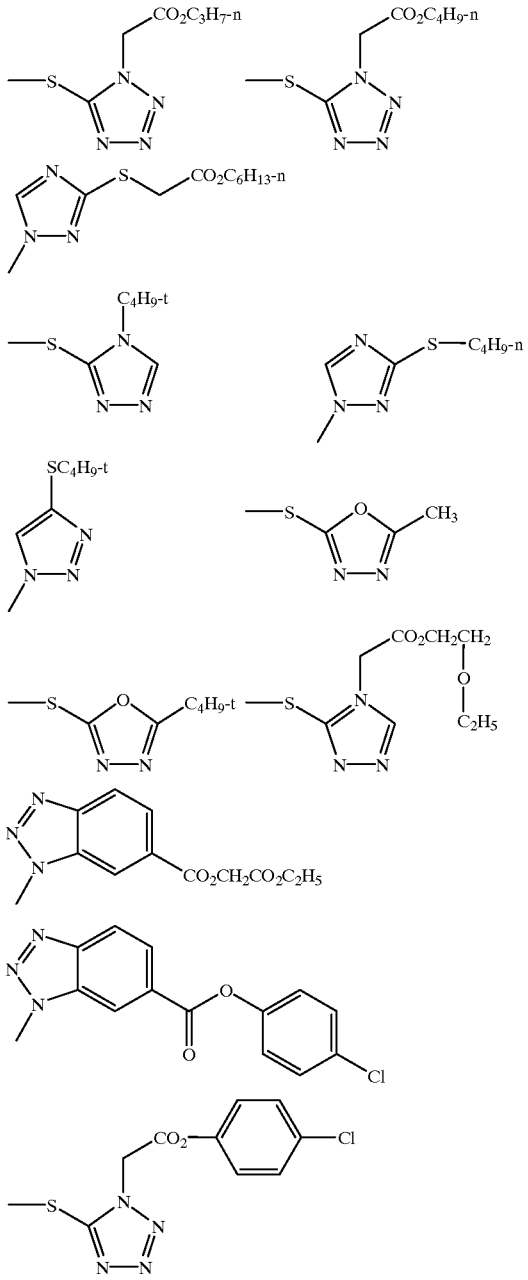

The more preferred inhibitor fragments are mercaptotetrazoles and benzotriazoles that contain a hydrolyzable group such as those discussed previously.

The materials of the invention can be added to a solution containing silver halide before coating or be mixed with the silver halide just prior to or during coating. In either case, additional components like couplers, doctors, surfactants, hardeners and other materials that are typically present in such solutions may also be present at the same time. The materials of the invention are not water soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent that is stabilized by suitable surfactants and surface active agents usually in combination with a binder or matrix such as gelatin. The dispersion may contain one or more permanent coupler solvent that dissolves the material and maintains it in a liquid state. Some examples of suitable permanent coupler solvents are tricresylphosphate, N,N-diethyllauramide, N,N'-dibutyllauramide, p-dodecylphenol, dibutylpthalate, di-n-butyl sebacate, N-n-butylacetanilide, 9-octadec-en-1-ol, ortho-methylphenyl benzoate, trioctylamine and 2-ethylhexylphosphate. The dispersion may require an auxiliary coupler solvent to initially dissolve the component but is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water solubilizing groups or have regions of high hydrophilicity. Some examples of suitable dispersing agents or surfactants are Alkanol XC or saponin. It is also possible to incorporate the materials of the invention as a solid particle dispersion; that is, a slurry or suspension of finely ground (though mechanical means) compound. These solid particle dispersions maybe additionally stabilized with surfactants and/or polymeric materials as known in the art. In addition, additional coupler solvent may be added to the solid particle dispersion to help increase activity. The materials of the invention may also be dispersed as an admixture with another component of the system such as a coupler or a oxidized developer scavenger so that both are present in the same oil droplet.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylurcido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Patent Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777, and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0257 854; EPO 0 284 240; EPO 0 341 204; EPO 347,235; EPO 365,252; EPO 0 422 595; EPO 0 428 899; EPO 0 428 902; EPO 0 459 33 1; EPO 0 467 327; EPO 0 476 949; EPO 0 487 08 1; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. No. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

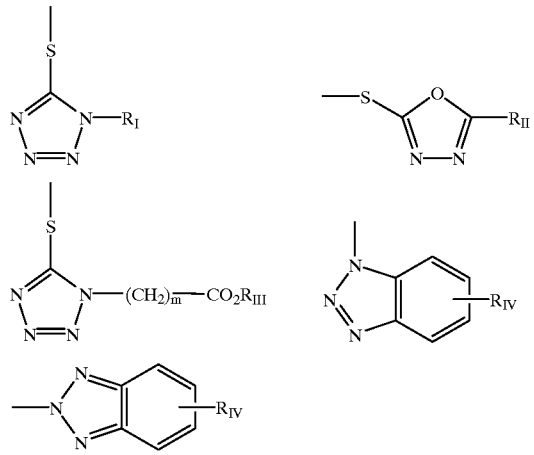

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and mn is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

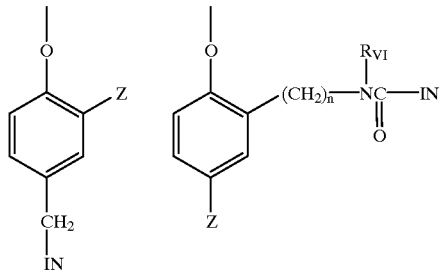

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Aside from the compound of Formula III of the invention, suitable developer inhibitor-releasing couplers that may be included in photographic light sensitive emulsion layer include, but are not limited to, the following:

D1

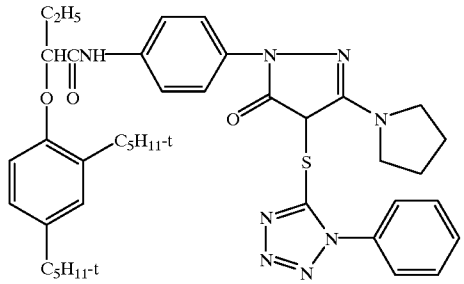

-continued

D2

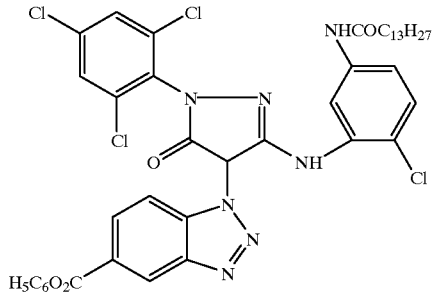

D3

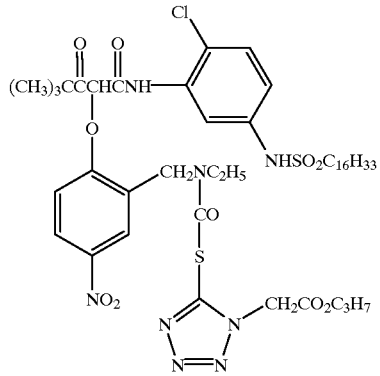

D4

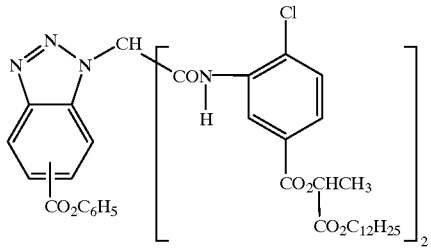

D5

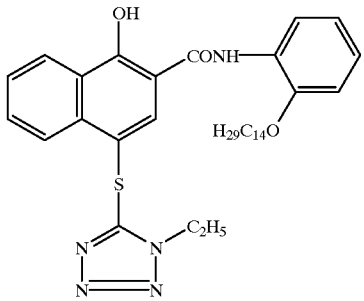

-continued
D6
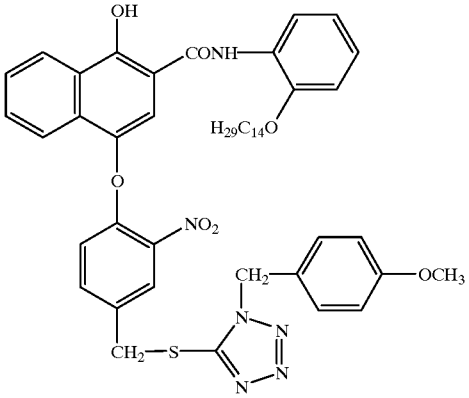
D7
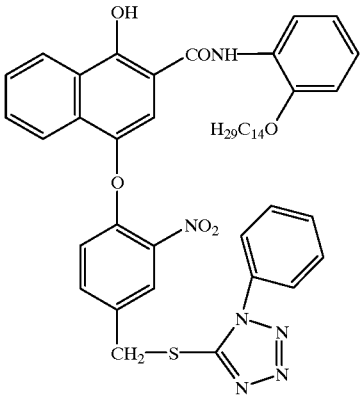
D8
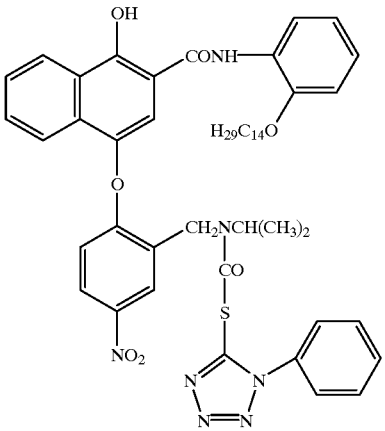
-continued
D9
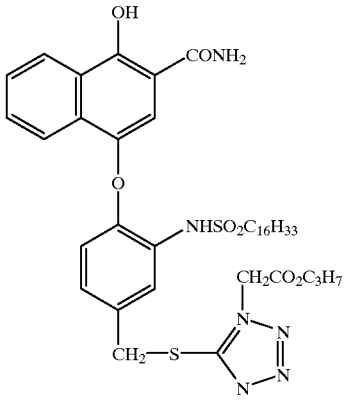
D10
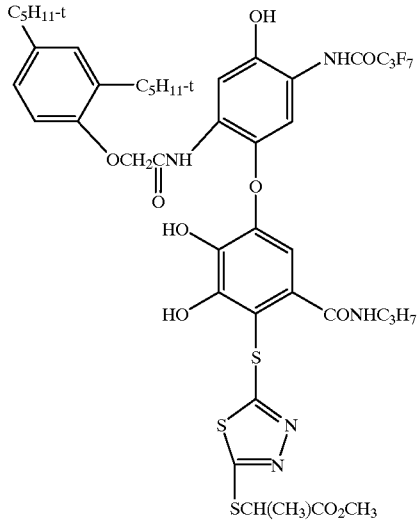
D11
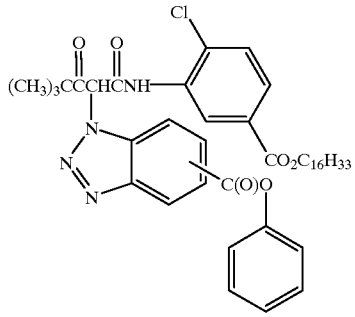
D12
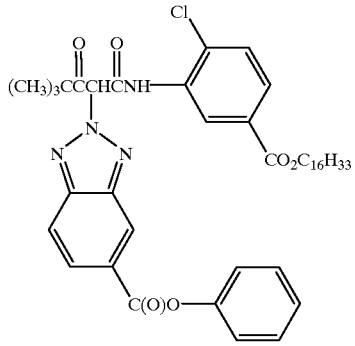

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. Nos. 5,310,635; 5,320,938; and 5,356,764.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of total grain projected area. Preferred tabular grain emulsions are those in which the average thickness of the tabular grains is less than 0.3 micrometer (preferably thin— that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. No. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(2-methanesulfonamidoethyl) aniline sesquisulfate hydrate,
4-amino-3-methyl-N-ethyl-N-(2-hydroxyethyl)aniline sulfate,
4-amino-3-(2-methanesulfonamidoethyl)-N,N-diethylaniline hydrochloride, and
4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications referred to in this specification are incorporated herein by reference.

Synthesis Example

Preparation of 6-decyloxypurine (IEH-A)

1-Decanol (13ml, 68.2mmol) was added in one portion to a stirred suspension of a 60% dispersion of sodium hydride in oil (2.70 g, 67.5mmol) in dry tetrahydrofuran (70 ml) under an atmosphere of nitrogen. Gas was evolved. After 0.5 h 6-chloropurine (3.00 g, 19.4 mmol) was added and the suspension heated at reflux for 3.5 h. The tetrahydrofuran was removed in vacuo and the residue suspended in dilute hydrochloric acid (200 ml). The acidic suspension was stirred for 1 h then neutralised with saturated sodium hydrogen carbonate solution. The suspension was stirred vigorously with 60–80 petroleum ether (500 ml) and the solid removed by filtration. The solid was recrystallised from methanol to give a white solid (3.29 g, 11.9 mmol, 61%).

Photographic Examples

The invention is illustrated in the following bilayer and multilayer examples. Bilayer photographic elements were prepared by coating the following layers on a cellulose triacetate film support (coverages are in g/m$^2$). Unless otherwise noted, all comparative and inventive compounds were dispersed in twice their own weight of N,N-dibutyllauramide:

Layer 1 (Antihalation Layer): black colloidal elemental silver at 0.34 and gelatin at 2.41.

Layer 2 (Receiver Layer): gelatin at 2.79, CDIR-2 at 0.03, coupler M-1 (dispersed as described previously) added at 0.045, comparison material (CIEH) or IEH added at $7.2\times10^{-3}$ mmol/m$^2$ (this corresponds to 0.96 mmol per mole silver) dispersed in twice its own weight of N,N-dibutyllauramide and 0.81 green sensitized AgIBr tabular emulsion.

Layer 3 (Interlayer): gelatin at 0.64, ILS-1 at 0.11 and FD-1 at 0.11.

Layer 4 (Causer Layer): gelatin at 2.79, coupler Y-1 at 0.91, 0.79 blue sensitized AgIBr tabular emulsion and IDIR-2 at 0.11 mmol/m$^2$.

Layer 5 (Overcoat): gelatin at 2.79 and 0.02 bis-vinylsulfonemethylether.

The structures of the couplers and comparative materials used, along with the corresponding ClogP where appropriate, in the above format were as follows:

M-1:

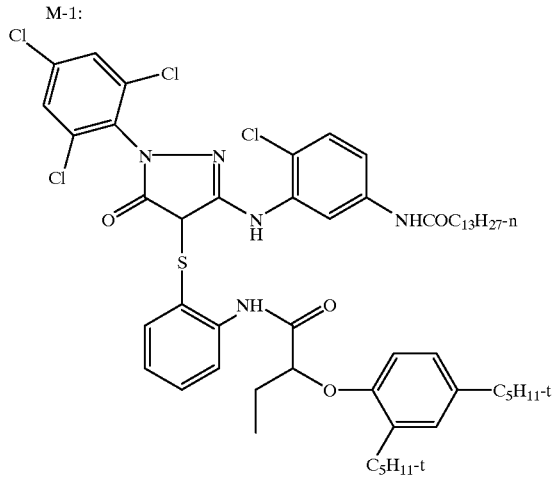

-continued

ILS-1:

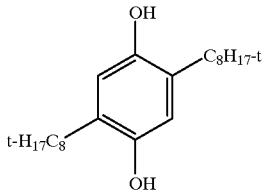

Y-1:

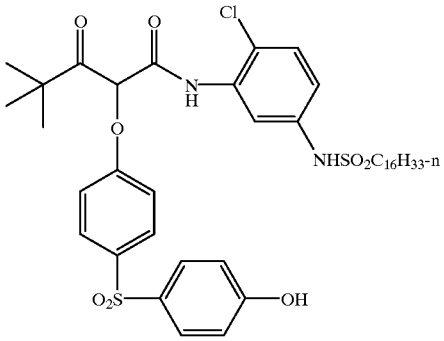

YFD-1:

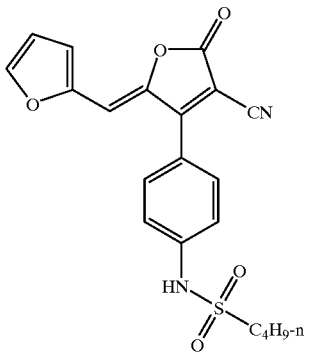

CIEH-1:
(5.52)

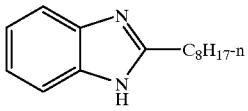

CIEH-2:
(8.18)

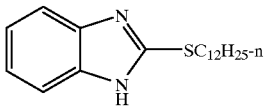

CIEH-3:
(8.05)

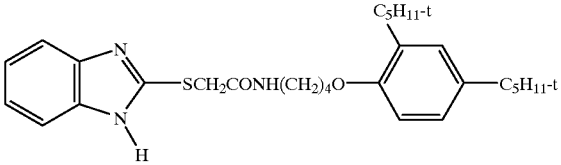

CIEH-4:
(3.95)

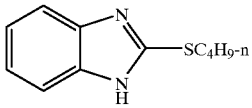

-continued

CIEH-5:
(3.81)

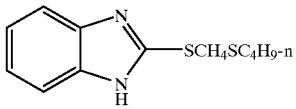

CIEH-6:
(11.35)

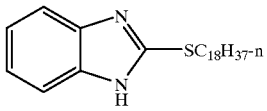

CIEH-7:
(7.26)

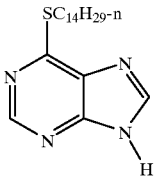

CIEH-8:
(0.20)

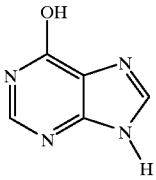

CIEH-9:
(0.83)

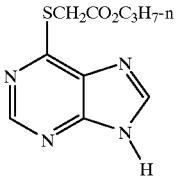

CIEH-10:
(8.03)

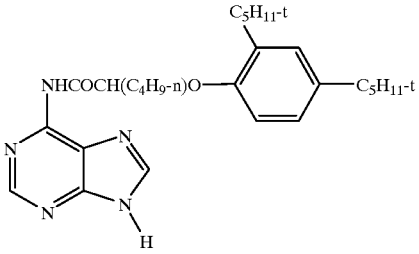

Samples of each element were given a stepped exposure of either green light only or blue and green light combined and processed in the KODAK FLEXICOLOR™ (C-4 1) process as described in *British Journal of Photography Annual,* 1988, pp 196–198. Contrast of the elements was determined using the maximum slope between any two density points. In this test, the ratio of the contrast of the green only exposure to the contrast of the green of a blue and green exposure ($C_g/C_{b+g}$) is a measure of the interimage. A higher ratio means more inhibition originating from the blue and affecting the green record. Results are shown in Table II.

TABLE II

Interimage in Bilayer Formats-IDIR-2 in Blue Layer

| Sample | Comp/Inv | IEH | $C_g/C_{b+g}$ | CLogP |
|---|---|---|---|---|
| BL-1 | Comp | None | 1.23 | |
| BL-2 | Comp | CIEH-1 | 1.19 | 5.52 |
| BL-3 | Comp | CIEH-2 | 1.27 | 8.18 |
| BL-4 | Comp | CIEH-3 | 1.23 | 8.05 |
| BL-5 | Comp | CIEH-4 | 1.29 | 3.81 |
| BL-6 | Comp | CIEH-5 | 1.33 | 3.60 |
| BL-7 | Comp | CIEH-6 | 1.21 | 11.35 |
| BL-8 | Comp | CIEH-7 | 1.22 | 7.26 |
| BL-9 | Comp | CIEH-8 | 1.17 | 0.20 |
| BL-10 | Comp | CIEH-9 | 1.19 | 0.83 |
| BL-11 | Comp | CIEH-10 | 1.22 | 8.03 |
| BL-12 | Inv | IEH-A | 1.45 | 4.80 |
| BL-13 | Inv | IEH-B | 1.47 | 5.86 |
| BL-14 | Inv | IEH-E | 1.51 | 5.15 |
| BL-15 | Inv | IEH-G | 1.85 | 4.75 |
| BL-16 | Iny | IEH-H | 1.51 | 5.80 |
| BL-17 | Inv | IEH-I | 1.63 | 4.70 |
| BL-18 | Inv | IEH-X | 1.35 | 6.98 |

Comparison of the examples in Table II show that the interimage improvement occurs only with the IEHs with the specified CLogP range with a weak DIR of the invention. Other bicyclic heterocycles such as benzimidazoles do not show the effect irregardless of their ClogP.

Another set of bilayer experiments using the same format were prepared using the IEH at higher ratios of material to silver. These were exposed and processed as described above. Relative light sensitivity (speed) was determined by normalizing the exposure point +0.15 density units above Dmin to the comparative check position. Results are shown in Table III.

TABLE III

Speed and Interimage

| Sample | Comp/Inv | IEH | Ratio mmoles IEH to mol Ag | $C_g/C_{b+g}$ | Relative Speed |
|---|---|---|---|---|---|
| BL-19 | Comp | — | — | 1.23 | 1.00 |
| BL-20 | Inv | IEH-A | 0.96 | 1.56 | 0.94 |
| BL-21 | Inv | IEH-A | 4.8 | 1.72 | 0.81 |
| BL-22 | Inv | IEH-A | 9.6 | 1.67 | 0.43 |
| BL-23 | Inv | IEH-B | 0.96 | 1.51 | 0.97 |
| BL-24 | Inv | IEH-B | 4.8 | 1.55 | 0.92 |
| BL-25 | Inv | IEH-B | 9.6 | 1.57 | 0.91 |

The example in Table III illustrate that while higher ratios of IEH to silver maintain the desirable improvement in interimage, there can be a decrease in speed.

Multilayer films demonstrating the principles of this invention were produced by coating the following layers on a cellulose triacetate film support (coverage are in grams per meter squared, emulsion sizes as determined by the disc centrifuge method and are reported in Diameter×Thickness in microns).

EXAMPLE ML-1

Layer 1 (Antihalation layer): black colloidal silver sol at 0.135; ILS-1 at 0.162, DYE-1 at 0.018; DYE-2 at 0.025 ; DYE-3 at 0.035; UV-1 at 0.060; UV-2 at 0.015; and gelatin at 2.05.

Layer 2 (Slow cyan layer): a blend of two red sensitized (both with a mixture of RSD-1 and RSD-2) tabular silver iodobromide emulsions: (i) 0.66×0.12, 4.1 mole % I at 0.302 (ii) 0.55×0.08, 1.5 mole % I at 0.464; cyan dye-forming coupler C-1 at 0.535; DIR coupler CDIR-1 at 0.027; bleach accelerator releasing coupler B-1 at 0.057; masking coupler MC-1 at 0.032; and gelatin at 1.68.

Layer 3 (Mid cyan layer): a blend of two red sensitized (same as above) tabular silver iodobromide emulsions: (i) 0.1.22×0.11, 4.1 mole % I at 0.194 (ii) 1.07×0.11, 4.1 mole % I at 0.238; cyan coupler C-1 at 0.171; CDIR-1 at 0.019; MC-1 at 0.032; B-1 at 0.008; and gelatin at 1.08.

Layer 4 (Fast cyan layer): a red sensitized (same as above) tabular silver iodobromide emulsion (1.33×0.12, 4.1 mole % I) at 0.594; C-1 at 0.184; CDIR-1 at 0.027; MC-1 at 0.022; and gelatin at 0.918.

Layer 5 (Interlayer): ILS-1 at 0.086 and gelatin at 0.540.

Layer 6 (Slow magenta layer): a blend of two green sensitized (both with a mixture of GSD-1 and GSD-2) silver iodobromide emulsions: (i) 0.81×0.12, 2.6 mole % iodide at 0.346 and (ii) 0.55×0.08, 1.5 mole % iodide at 0.130; magenta dye forming coupler M-1 at 0.270; MC-2 at 0.086; IDIR-5 at 0.011; and gelatin at 1.08.

Layer 7 (Mid magenta layer): a blend of two green sensitized (same as above) tabular silver iodobromide emulsions (i) 1.22×0.11, 4.1 mole % I at 0.248 and (ii) 1.07×0.11, 4.1 mole % I at 0.248; M-1 at 0.124; MC-2 at 0.119; IDIR-5 at 0.043; OxDS-2 at 0.016; and gelatin at 1.22.

Layer 8 (Fast magenta layer): a green sensitized tabular silver iodobromide (1.33×0.12, 4.1 mole % I) emulsion at 0.486; M-1 at 0.076; MC-2 at 0.054; B-1 at 0.003; IDIR-1 at 0.030; OxDS-2 at 0.009; and gelatin at 1.02.

Layer 9 (Yellow filter layer): yellow filter dye YFD-1 at 0.054; ILS-1 at 0.086; and gelatin at 0.648.

Layer 10 (Slow yellow layer): a blend of three blue sensitized (all with a mixture of BSD-1 and BSD-2) tabular silver iodobromide emulsions (i) 0.55×0.08, 1.5 mole % I at 0.270 (ii) 0.0.77×0.14, 1.5 mole % I at 0.248 and (iii) 1.25×0.14, 4.1 mole % I at 0.400; yellow dye forming coupler Y-2 at 1.08; IDIR-6 at 0.076; CDIR-1 at 0.032; B-1 at 0.022; and gelatin at 1.879.

Layer 11 (Fast yellow layer): a blend of two blue sensitized (both with a mixture of BSD-1 and BSD-2) tabular silver iodobromide emulsions (i) 1.25×0.14, 4.1 mole % I at 0.108 (ii) 2.67×0.13, 4.1 mole % I at 0.378; Y-2 at 0.238; IDIR-6 at 0.076; B-1 at 0.005; and gelatin at 0.810.

Layer 12 (Protective overcoat and UV filter layer): silver bromide Lippman emulsion at 0.216; UV-1 at a total of 0.108; gelatin at 1.242 and bis(vinylsulfonyl)methane hardener at 1.75% of total gelatin weight.

Surfactants, coating aids, emulsion addenda, sequestrants, thickeners, lubricants, matte and tinting dyes were added to the appropriate layers as is common in the art. Structures of the materials used in this multilayer format are as follows:

Y-2:
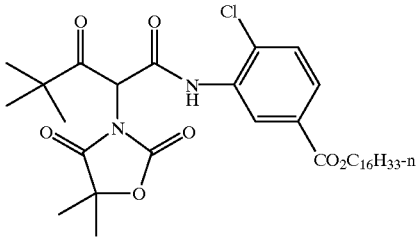
OxDS-2:
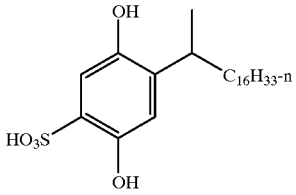
DYE-1:
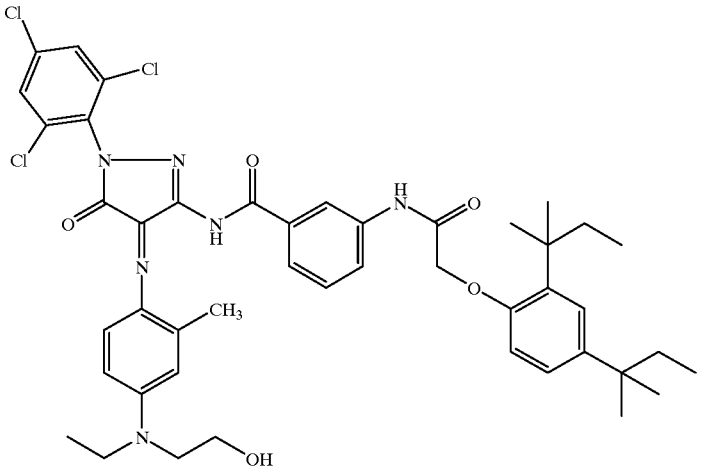
DYE-2:
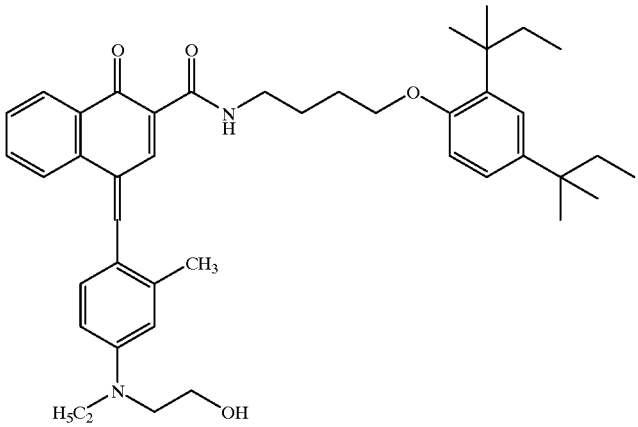

-continued
DYE-3:
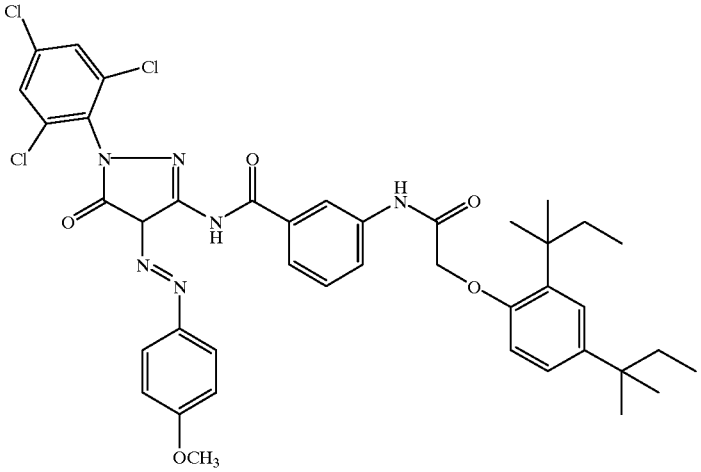
UV-1:
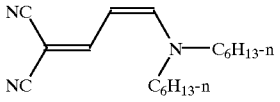
UV-2:
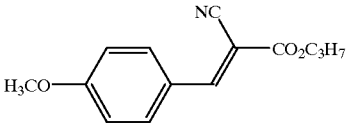
C-1:
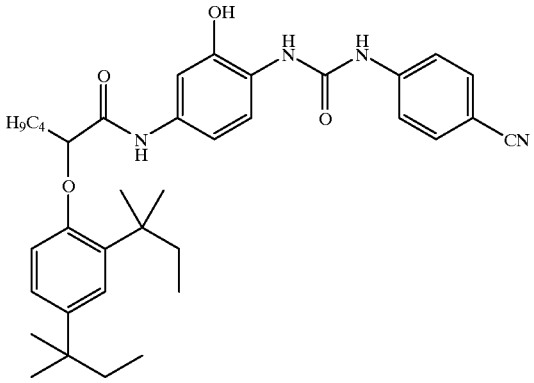
B-1:
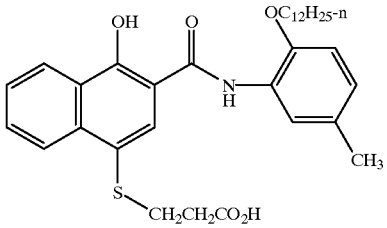
MC-1:
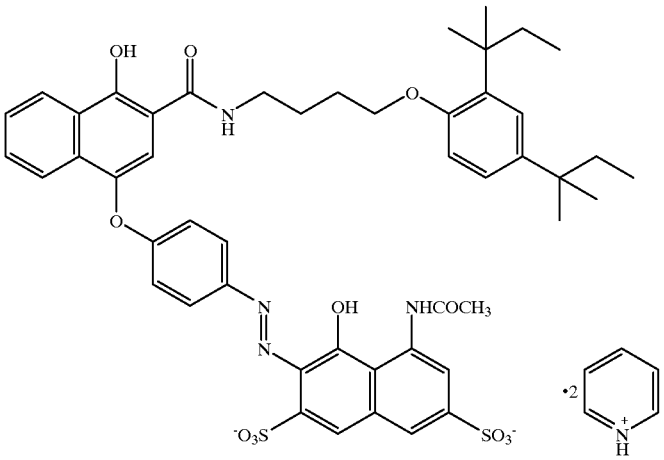

-continued

MC-2:

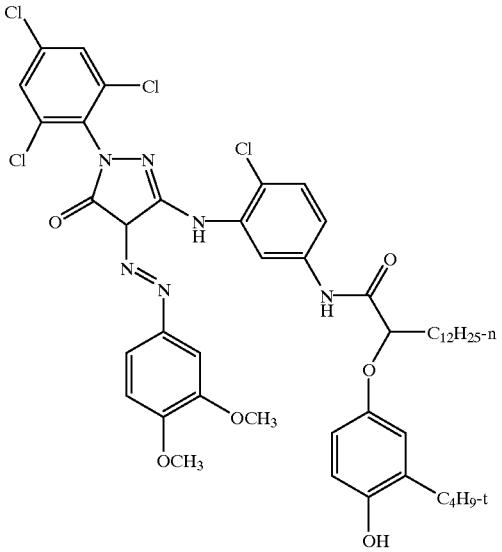

RSD-1:

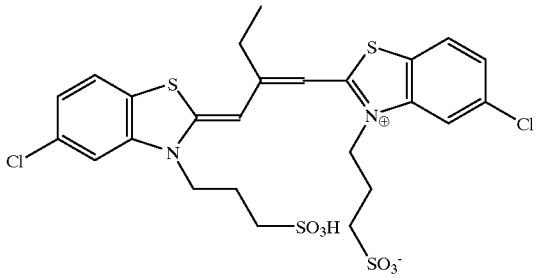

RSD-2:

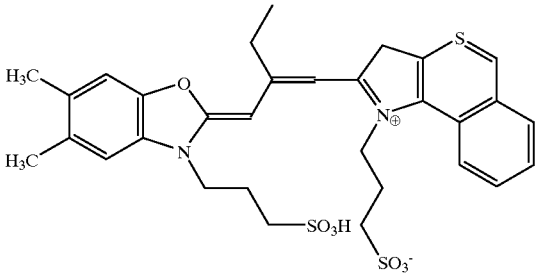

GSD-1:

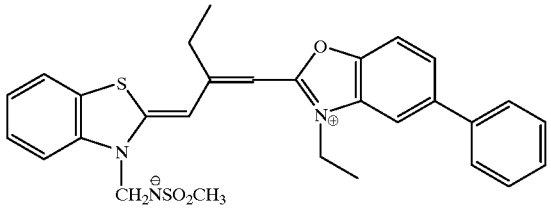

GSD-2:

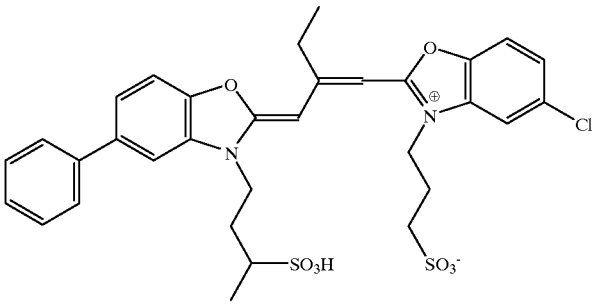

BSD-1:

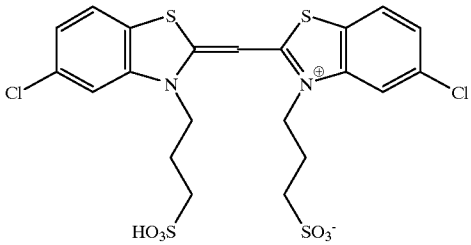

BSD-2:

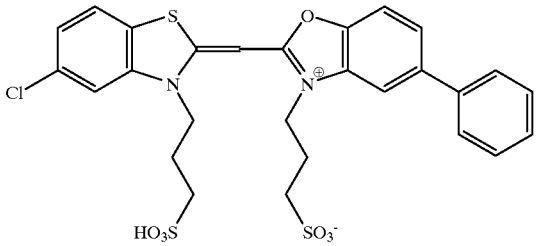

Sample ML-2 was prepared like ML-1 except that IDIR-6 in Layers 10 and 11 was replaced with IDIR-2 at 0.097.

Sample ML-3 was prepared like ML-1 except that IEH-A was added to Layers 7 and 8 at 0.0012 (corresponding to 0.8 mmol IEH-A to mole of silver in that layer).

Sample ML-4 was prepared like ML-2 except that IEH-A was added to Layers 7 and 8 at 0.0012.

These multilayer coatings were given a stepped exposure in one color record but only flashed (non-imagewise exposure) in the other two records and processed as described for the bilayer experiments. To monitor interimage, a step nearest to density of 1.5 in the stepped color record (the causers; in this case, the blue record or red records) was chosen, and the difference in density of the other color records (the receiver; in this case the green record) at that step and at the no exposure step of the causer was determined. A more negative number in B→G or R→G (causer→receiver) means a larger drop in density in the receiver and increased interimage. Results are shown in Table III.

TABLE III

| Interimage in Multilayer Formats | | | | | | |
|---|---|---|---|---|---|---|
| Sample | Inv/ Comp | IEM in Green | DIR in Blue | DIR in Red | B→G | R→G |
| ML-1 | Comp | — | IDIR-6 | CDIR-1 | −0.101 | −0.273 |
| ML-2 | Comp | — | IDIR-2 | CDIR-1 | −0.131 | −0.287 |
| ML-3 | Inv | IEH-A | IDIR-6 | CDIR-1 | −0.106 | −0.236 |
| ML-4 | Inv | IEH-A | IDIR-2 | CDIR-1 | −0.164 | −0.268 |

The results in TABLE III show an increase in interimage from the layer where the mild DIR is located (in these examples, the blue layer) onto the layer where the IEH is present (in these examples, the green layer). Compare ML-1 with ML-3 and ML-2 with ML-4. On the other hand, interimage is not increased from layers that contain a strong DIR not of the invention (in these examples, CDIR-1 located in the red layer) even if the IEH is present.

The invention has been described in detail with particular reference to preferred embodiments thereof, but it will be understood that variations and modifications can be effected within the scope and spirit of the invention.

What is claimed is:

1. A color photographic element comprising:

(a) a first light sensitive silver halide emulsion layer containing a compound with an aromatic bicyclic nitrogen nucleus of which at least one ring is six-membered and with two nitrogen ring atoms in each ring and with at least one N—H bond provided that the ClogP for the compound is at least 2.0 and less than 7.2, which compound is not a coupler and does not react with oxidized developer; and (b) a second light sensitive silver halide emulsion layer, having a spectral sensitivity different from that of the first light sensitive silver halide emulsion layer, containing a compound of Formula III:

$$\text{COUP-(TIME)}_j\text{-INH} \qquad \text{III}$$

wherein:

COUP is a coupler parent group capable of forming a dye upon reaction with an oxidized developer;

TIME is a timing group and j is 0, 1 or 2; and

INH is a mild silver development inhibitor fragment.

2. The color photographic element of claim 1 wherein the ClogP of the aromatic bicyclic nitrogen compound is at least 3.0 but less than 7.0.

3. The color photographic element of claim 1 wherein the ClogP of the aromatic bicyclic nitrogen compound is at least 4.0 but less than 6.2.

4. The color photographic element of claim 1 wherein the INH of the compound in Formula III contains a hydrolyzable group.

5. The color photographic element of claim 1 wherein the INH of the compound in Formula III is a mercaptotetrazole group.

6. The color photographic element of claim 1 wherein the INH of the compound in Formula III is a N-alkyl mercaptotetrazole group containing an ester group in the alkyl chain.

7. The color photographic element of claim 1 wherein j in the compound of Formula III is at least one.

8. The color photographic element of claim 1 wherein INH in the compound in Formula III is a benzotriazole group.

9. The color photographic element of claim 1 wherein the INH of the compound in Formula III is a triazole or tetrazole group.

10. The color photographic element of claim 3 wherein the INH of the compound in Formula III is a mercaptotetrazole group.

11. The color photographic element of claim 3 wherein the INH of the compound in Formula III is a benzotriazole group.

12. The color photographic element of claim 1 wherein the aromatic bicyclic nitrogen compound is a 1,3,4,6-tetraazaindene (purine).

13. The color photographic element of claim 12 wherein the 1,3,4,6-tetraazaindene (purine) is according to Formula I:

I

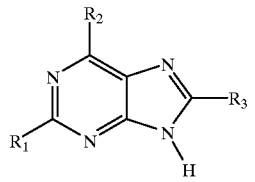

wherein, $R_1$, $R_2$ and $R_3$ are independently hydrogen or an alkyl, phenyl, ether, thioether, sulfoxide, sulfone, sulfamoyl, chloro, bromo, iodo, cyano, nitro, —O—CO—, —O—$SO_2$—, heterocyclic, carbonyl group or amino group.

14. The color photographic element of claim 1 wherein the aromatic bicyclic nitrogen compound is a 1,2,5,7-tetraazaindene (1H-pyrazolo[3,4-d]pyrimidine).

15. The color photographic element of claim 14 wherein the 1,2,5,7-tetraazaindene is according to Formula IIa:

IIa

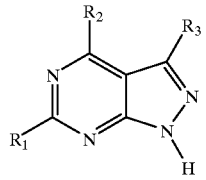

wherein, $R_1$, $R_2$ and $R_3$ are independently hydrogen or an alkyl, phenyl, ether, thioether, sulfoxide, sulfone, sulfamoyl, chloro, bromo, iodo, cyano, nitro, —O—CO—, —O—$SO_2$—, heterocyclic, carbonyl group or amino group.

16. The color photographic element of claim 1 wherein the aromatic bicyclic nitrogen compound is a 1,2,4,6-tetraazaindene.

17. The color photographic element of claim 16 wherein the 1,2,4,6-tetraazaindene is according to Formula IIb:

IIb

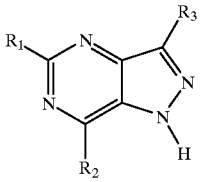

wherein $R_1$, $R_2$ and $R_3$ are independently hydrogen or an alkyl, phenyl, ether, thioether, sulfoxide, sulfone, sulfamoyl, chloro, bromo, iodo, cyano, nitro, —O—CO—, —O—$SO_2$—, heterocyclic, carbonyl group or amino group.

18. The color photographic element of claim 3 wherein the aromatic bicyclic nitrogen compound is a 1,3,4,6-tetraazaindene (purine).

19. The color photographic element of claim 3 wherein the aromatic bicyclic nitrogen compound is selected from a 1,2,5,7-tetraazaindene (1H-pyrazolo[3,4-d]pyrimidine) or 1,2,4,6-tetraazaindene.

20. The color photographic element of claim 1 wherein the compound of Formula III is selected from the group consisting of the following compounds:

IDIR-1:

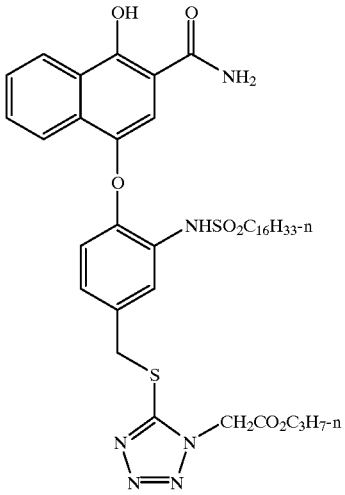

IDIR-2:

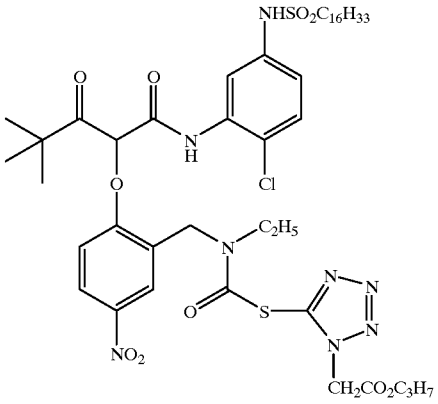

-continued

IDIR-3:

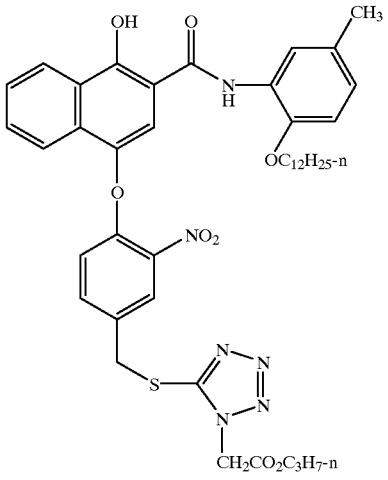

and

IDIR-8:

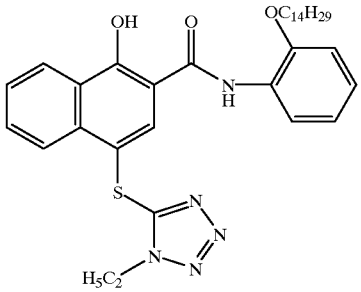

21. The color photographic element of claim 3 wherein the compound of Formula III is selected from the group consisting of the following compounds:

IDIR-1:

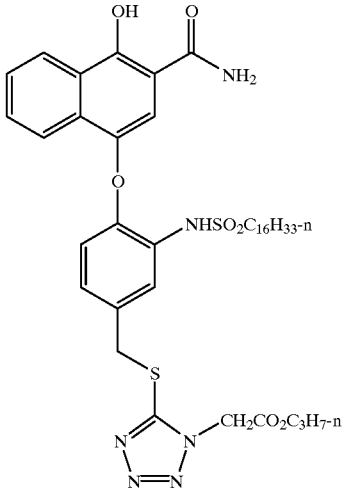

-continued

IDIR-2:

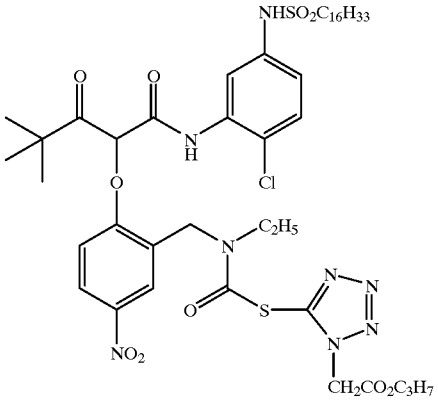

IDIR-3:

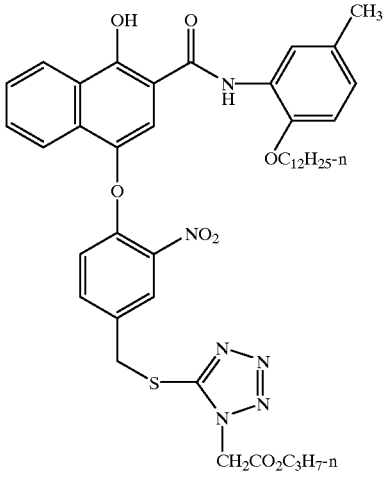

and

IDIR-8:

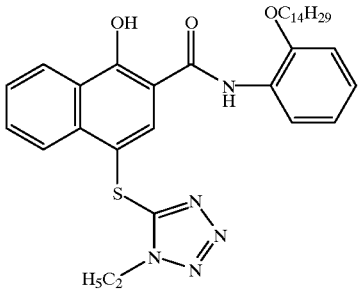

22. The color photographic element of claim 12 wherein the 1,3,4,6-tetraazaindene is selected from the group consisting of the following compounds:

IEH-A:

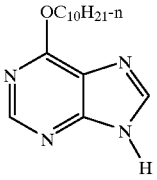

-continued

IEH-E:

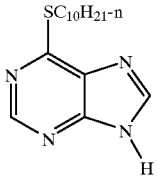

IEH-I:

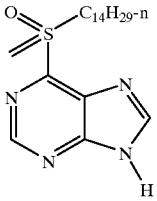

and

IEH-G:

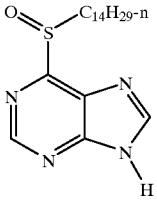

23. The color photographic element of claim 12 wherein the 1,3,4,6-tetraazaindene is represented by Formula I:

I

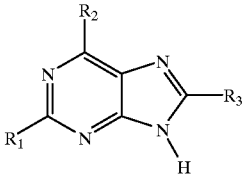

wherein $R_3$ is hydrogen or an alkyl, phenyl, ether, thioether, sulfoxide, sulfone, halide, cyano, thiol, hydroxy, nitro, —O—CO—, —O—$SO_2$—, heterocyclic, carbonyl or amino group; and $R_2$ is an alkyloxy, aryloxy, alkylthio, arylthio, sulfonyl, sulfoxide or amino group.

24. The color photographic element of claim 23 wherein $R_3$ is hydrogen.

25. The color photographic element of claim 24 where INH of the compound in Formula III is a mercaptotetrazole group.

26. The color photographic element of claim 1 wherein the laydown of the aromatic bicyclic nitrogen compound is at least 0.01 mmol of compound per mole of silver in the layer.

27. The color photographic element of claim 1 wherein the laydown of the aromatic bicyclic nitrogen compound is at least 0.1 mmol of compound per mole of silver but at most equal to or less than 2.5 mmol per mole of silver.

28. The color photographic element of claim 1 wherein the laydown of the nitrogen heterocycle compound is at least 0.1 mmol of compound per mole of silver but at most equal to or less than 1.0 mmol per mole of silver.

29. The color photographic element of claim 2 wherein the laydown of the aromatic bicyclic nitrogen compound is at least 0.1 mmol of compound per mole of silver but at most equal to or less than 1.0 mmol per mole of silver.

30. The color photographic element of claim 3 wherein the laydown of the aromatic bicyclic nitrogen compound is at least 0.1 mmol of compound per mole of silver but at most equal to or less than 1.0 mmol per mole of silver.

31. The color photographic element of claim 12 wherein the laydown of the 1,3,4,6-tetraazaindene is at least 0.1 mmol of compound per mole of silver but at most equal to or less than 1.0 mmol per mole of silver.

32. The color photographic element of claim 14 wherein the laydown of the 1,2,5,7-tetraazaindene compound is at least 0.1 mmol of compound per mole of silver but at most equal to or less than 1.0 mmol per mole of silver.

33. The color photographic element of claim 16 wherein the laydown of the 1,2,4,6-tetraazaindene compound is at least 0.1 mmol of compound per mole of silver but at most equal to or less than 1.0 mmol per mole of silver.

34. A color photographic element comprising:

(a) a first light sensitive silver halide emulsion layer containing a compound with an aromatic bicyclic nitrogen nucleus of which at least one ring is six-membered and with two nitrogen ring atoms in each ring and with at least one N—H bond and is substituted with an alkyloxy, aryloxy, alkylthio, arylthio, sulfonyl, sulfoxide or amino group that contains a minimum of 6 carbon atoms, provided that the ClogP for the compound is at least 2.0 and less than 7.2, which compound is not a coupler and does not react with oxidized developer; and (b) a second light sensitive silver halide emulsion layer, having a spectral sensitivity different from that of the first light sensitive silver halide emulsion layer, containing a compound of Formula III:

$$\text{COUP-(TIME)}_j\text{-INH} \qquad \text{III}$$

wherein:

COUP is a coupler parent group capable of forming a dye upon reaction with an oxidized developer;

TIME is a timing group and j is 0, 1 or 2; and

INH is a mild silver development inhibitor fragment.

35. A color photographic element of claim 34 wherein the laydown of the aromatic bicyclic nitrogen compound is at least 0.1 mmol of compound per mole of silver but at most equal to or less than 1.0 mmol per mole of silver.

36. A color photographic element of claim 34 wherein the aromatic bicyclic nitrogen compound is selected from a 1,3,4,6, 1,2,4,6 or a 1,2,4,7-tetraazaindene.

37. A color photographic element of claim 36 wherein the laydown of the aromatic bicyclic nitrogen compound is at least 0.1 mmol of compound per mole of silver but at most equal to or less than 1.0 mmol per mole of silver.

* * * * *